United States Patent [19]

Jochum

[11] 4,201,325

[45] May 6, 1980

[54] FASTENING ELEMENT SETTING DEVICE

[75] Inventor: Peter Jochum, Meiningen, Austria

[73] Assignee: Hilti Aktiengesellschaft, Schaan, Liechtenstein

[21] Appl. No.: 950,545

[22] Filed: Oct. 12, 1978

[30] Foreign Application Priority Data

Oct. 13, 1977 [DE] Fed. Rep. of Germany ..... 2746120

[51] Int. Cl.[2] ..... B25C 1/18

[52] U.S. Cl. ..... 227/9; 227/149

[58] Field of Search ..... 227/9, 10, 11, 149; 29/254; 72/430; 173/90

[56] References Cited

U.S. PATENT DOCUMENTS

| | | | |
|---|---|---|---|
| 2,666,915 | 1/1954 | Erickson | 227/11 |
| 3,250,451 | 5/1966 | Fulop | 227/10 X |
| 3,323,705 | 6/1967 | Grotsch et al. | 227/10 X |
| 3,816,895 | 6/1974 | Kuehn et al. | 227/149 X |

FOREIGN PATENT DOCUMENTS

| | | | |
|---|---|---|---|
| 776372 | 6/1957 | United Kingdom | 227/11 |

*Primary Examiner*—Paul A. Bell

*Attorney, Agent, or Firm*—Toren, McGeady and Stanger

[57] ABSTRACT

A sleeve-like holding member is positioned within the housing of an explosive powder operated gun-like setting device for gripping the fastening element before it is propelled from the housing. The holding member has at least one axially extending slot so that it is radially expandable against its own inherent tension. When a plurality of slots are provided, they are spaced angularly apart and extend from one end toward but short of the other end of the holding member. Adjacent slots extend from different ends of the holding member.

4 Claims, 3 Drawing Figures

FASTENING ELEMENT SETTING DEVICE

SUMMARY OF THE INVENTION

The present invention is directed to an explosive powder operated setting device for driving fastening elements, such as bolts, nails and the like, into a hard receiving material, such as steel, concrete and the like, and, more particularly, it is directed to a holding member for gripping a fastening element in position in front of a barrel prior to driving the fastening element into the receiving material.

Explosive powder operated setting devices are used to drive fastening elements into a wall, a ceiling or a floor. Various holding members are known for preventing the fastening element from falling out of the barrel when the muzzle end of the barrel is directed downwardly. In one such example, the guide ring or disc positioned on the shank of the fastening element can be resilient or provided with resilient lugs so that it is clamped within the barrel bore. In practice, however, this is only used for plastic guide rings, while such rings made of steel require the holding member to be a part of the setting device. And example of one holding member is a magnet. The holding force of the magnet is relatively limited, however, and is not adequate, particularly when impact stresses occur in the setting device. In another known arrangement, spring-loaded clamping bodies have been employed for securing a fastening element within a setting device. The use of such a holding member is, however, very cumbersome, particularly for assembly purposes, and is unable to withstand impact or sharp loads, so that the parts of the clamping body need to be replaced after a short operating period.

Another known holding member is a sleeve made of relatively thin sheet metal positioned within the barrel of the setting device. To effect the holding action, tongues or blades are punched out of the sleeve and project inwardly affording a resilient gripping action. These tongues serve to hold a fastening element in the barrel. Unfortunately, only a low clamping force can be achieved. As a result of the alternating loads on these tongues, the tongues tend to break off after a certain time or at least their inherent tension weakens and a reliable holding action can no longer be attained.

It is the primary object of the present invention to provide a holding member with one or several axially extending slots so that the member can be expanded radially in opposition to its own inherent tension. As a result, a fastening element is held in place within the setting device by the inherent tension of the holding member. No additional spring means are needed which would make assembly more cumbersome. In the simplest embodiment, the holding member has a single axially extending slot and preferably extends over the entire axial length of the holding member. With such an arrangement, the holding member is radially expandable over its entire axial length. In the untensioned state, the inner diameter of the holding member should be somewhat smaller than the outer diameter of the guide ring of the fastening element which its secures.

In a universally useful setting device fastening elements of varying lengths can be used. With different lengths of fastening elements, however, the guide ring for the element is not always at the same location within the barrel of the setting device. To secure a fastening element within a particular axial length of the setting device, it is advantageous if the holding member is in the form of a sleeve. A tubular or sleeve-like holding member has the advantage that the fastening element is guided in the setting device, at least at the commencement of the driving operation. When a driving piston is used, a sleeve-like holding member can also serve to absorb a portion of any excess energy by virtue of its clamping action.

If only fastening elements of the same size are to be used in a setting device or if it can be ensured that the fastening element guide ring is always at the same location, it is advantageous if the holding member is in the form of a ring. If a ring-like holding member is employed, in addition to the savings in material, the assembly costs can be reduced, since the ring-holding member is inserted into the bore in a compressed state then expands radially into an appropriately dimensioned recess.

Where a single axially extending slot is provided in the holding member it results in a non-uniform distribution of stress over the circumference of the holding member. Therefore, to provide for a uniform stress distribution, it is preferred to provide the holding member with several axially extending slots. If a plurality of slots are employed, if possible, they should be distributed uniformly around the circumference of the holding member.

The holding member is weakened by the use of axially extending slots. Accordingly, when a plurality of such slots is employed, it is advantageous if they extend only over a portion of the axial length of the holding member. Preferably, the holding member is held together at least at its ends. If a number of slots extend over the entire axial length, the holding member would be divided into sections which, in turn, would require additional means for holding the individual sections together. Such a construction would substantially reduce the inherent tension of the holding member.

In an especially advantageous embodiment, adjacent slots extend from a different end of the holding member. With this arrangement, the holding member expands over its entire axial length in a uniform cylindrical manner. When the holding member is expanded, it retains its cylindrical shape. As a result, when a driving piston is used, the piston is not worn out by the holding member along one side.

When a fastening element is inserted, the holding member is expanded. To facilitate insertion and to prevent any canting of the guide ring during insertion, it is advantageous if the leading end of the holding member into which the fastening element is initially inserted is chamfered for aiding insertion.

In explosive powder operated setting devices, occasionally leakage losses occur when the escaping propellent gases flow ahead of or lead the driving piston or the fastening element. If the escaping propellent gases reach the space surrounding the holding member, a radial compression of the holding member takes place and a significant energy loss occurs as the fastening element is displaced. To avoid this possibility, it is advantageous if the leading end of the holding member is conically shaped with the conically shaped surface inclined inwardly away from the end of the barrel from which the fastening element is propelled. When a threaded bushing with a complementary conically shaped end is used for axially securing the holding member, it is then possible that the holding member will expand slightly when it is moved against the conically shaped end of the bushing by means of the friction forces caused by the fastening element or the driving piston.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention. dr

DETAIL DESCRIPTION OF THE INVENTION

Figures 1, 2, 3:
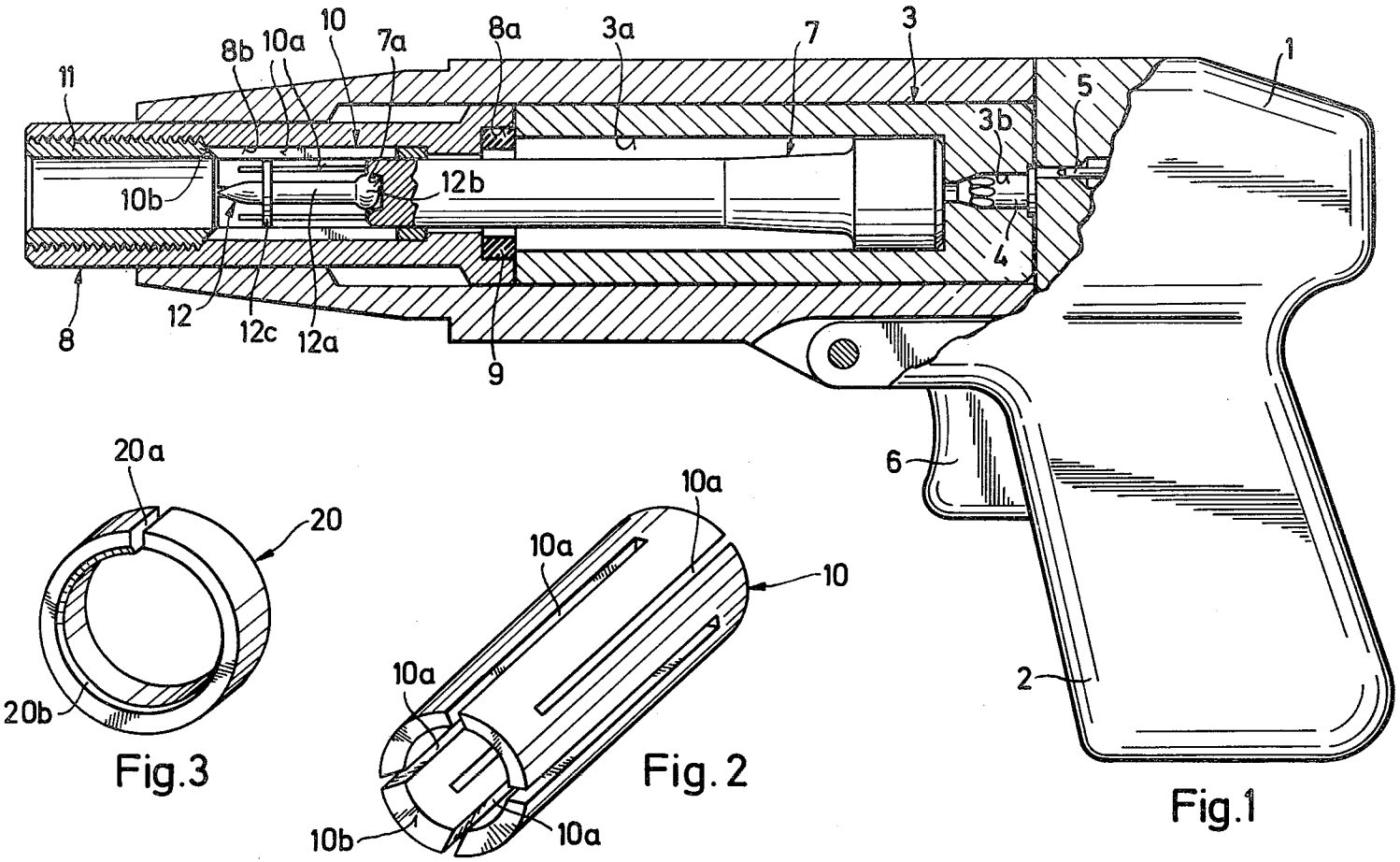
FIG. 1 is a side view, partly in section, of a setting device embodying the present invention.
FIG. 2 is a perspective view of the holding member illustrated in FIG. 1.
FIG. 3 is a perspective view of another embodiment of the holding member.

In FIG. 1 a setting device is illustrated comprising a gun-shaped housing 1 including handle grip 2. The housing forms an axially extending opening in which a barrel 3 is axially movably supported. The interior of the barrel forms an axially extending piston guide **3*a* and its rearward end, that is the end opposite the muzzle end of the housing, contains a cartridge chamber 3*b*. A cartridge 4 is positioned in the chamber 3*b*. Rearwardly of the cartridge 4 can be seen the front end of an ignition pin 5. A trigger 6 positioned in the upper portion of the handle grip 2 actuates the ignition pin. A driving piston 7 is guided within the piston guide 3*a*. Forwardly of the barrel 3, within the opening in the housing, is a bolt guide 8. The bolt guide 8 is coaxial with the barrel 3 and projects forwardly of the end of the housing from which fastening elements are driven. Defined by the forward end of the barrel 3 and the rearward end of the bolt guide 8 is a recess 8*a* containing a stop ring 9. Stop ring 9 serves to dissipate excess energy transmitted to the piston 7. Intermediate the ends of the bolt guide 8 is a through bore 8*b* having a slightly larger diameter than that portion of the bolt guide rearwardly of it. A tubular or sleeve-like holding member 10 is positioned in the through bore 8*b*. To provide it with radial expandability, the holding member has a plurality of elongated axially extending slots 10*a* spaced angularly apart around its circumference. Front end face 10*b* of the holding member is conically inclined, that is, it is inclined from its outer edge to its inner edge in the direction toward the rearward end of the barrel. This arrangement facilitates insertion of a fastening element 12 into the holding member ahead of the driving piston 7. The fastening element 12 consists of a shank 12*a*, a head 12*b* at its rearward end and a guide ring 12*c* positioned on the forward portion of the shank 12*a*. Head 12*b* of the fastening element 12 is supported within a countersunk recess 7*a* in the front end of the driving piston 7. Accordingly, the fastening element is guided by guide ring 12*c* and also by the countersunk recess 7*a* in the piston 7. A threaded bushing 11 is screwed into the front end of the bolt guide 8 and prevents the holding member 10 from falling out of the housing. To prevent the guide ring 12*c* from being held within the threaded bushing 11, the inside diameter of the bushing is made slightly larger than the outside diameter of the guide ring. The rearward end of the bushing 11 has a conical shape complementary to the front end face 10*b* of the holding member 10. This arrangement prevents a radial compression of the holding member 10 and also prevents the fastening element 12** from being held too tightly.

In FIG. 2 the holding member 10 of FIG. 1 is shown in a perspective view on a larger scale. As can be noted clearly in this Figure, the axially extending slots **10*a* alternate from opposite ends of the holding member 10. The slots do not extend for the full axial length of the holding member, rather each starts from one end and terminates before it reaches the other end. With this arrangement of the slots 10*a*, the holding member 10 expands cylindrically. Moreover, the conically shaped front end face 10*b*** is clearly shown in the Figure.

In FIG. 3 another holding member 20 is shown having an axial length much smaller than the embodiment in FIG. 2. Unlike the axially elongated holding member 10, the holding member 20 is ring-shaped and has a single axially extending slot **20*a*. The inner edge of the front end face of the holding member 20 has a chamfered surface 20*b* which facilitates insertion of a fastening element. When holding member 20 is used, the axial length of the through bore 8*b* can be made considerably shorter. If the width of the slot 20*a* permits the ring-like holding member to be sufficiently compressed, the threaded bushing 11 is unnecessary, since the holding member 20 can be locked in an appropriately dimensioned recess in the bolt guide 8**.

While specific embodiments of the invention have been shown and described in detail to illustrate the application of the inventive principles, it will be understood that the invention may be embodied otherwise without departing from such principles.

What is claimed is:

1. Explosive power operated gun-like setting device for driving fastening elements, such as bolts, nails and the like, into a hard receiving material, such as steel, concrete and the like, comprising a housing forming an axially elongated opening from which the fastening elements can be expelled, an axially extending barrel positioned within the opening in said housing and the axis of the barrel being substantially in parallel relation with the axis of the opening, an axially extending holding member located within the opening in said housing and positioned between said barrel and the end of the opening from which the fastening element is propelled, said holding member being slotted in the axial direction and being radially expandable against the inherent tension of said holding member for holding a fastening element before it is driven from the housing, the axis of said holding member being in substantially parallel relation with the axis of said barrel, wherein the improvement comprises that said holding member is an open ended sleeve-like member having a plurality of axially extending slots spaced angularly apart around said sleeve-like member, each of said slots extending for a portion of the axial length of said sleeve-like member and adjacent said slots each extend from a different end of said holding member.

2. Explosive powder operated gun-like setting device, as set forth in claim 1, wherein said holding member has one end thereof closer to the end of the opening in said housing from which the fastening element is propelled, and the radially inner edge of said one end is chamfered for facilitating the insertion of a fastening element into said holding member.

3. Explosive powder operated gun-like setting device, as set forth in claim 1, wherein said holding member has one end thereof closer to the end of the opening in said housing from which the fastening element is propelled, and the one end is frusto-conically shaped with the frusto-conically shaped end inclining inwardly from the radially outer edge thereof in the direction away from the opening in said housing from which the fastening element is propelled.

4. Explosive powder operated gun-like setting device, as set forth in claim 1, wherein a tubular bolt guide is located in the opening in said housing between said barrel and the end of the opening in said housing from which a fastening element is propelled, said bolt guide having an axially extending portion of the inner surface thereof with a larger diameter than at least another axially extending part thereof located closer to said barrel, said holding member positioned within the larger diameter axially extending portion of the inner surface of said bolt guide, and means for securing said holding member against axial displacement within said bolt guide.

* * * * *